US012326054B2

(12) United States Patent
Watkins et al.

(10) Patent No.: US 12,326,054 B2
(45) **Date of Patent: *Jun. 10, 2025**

(54) PNEUMATIC TRANSPORT SYSTEM AND METHOD FOR WELLBORE OPERATIONS

(71) Applicant: ADVANCED UPSTREAM LTD., Calgary (CA)

(72) Inventors: Tom Watkins, Calgary (CA); Jeyhun Najafov, Calgary (CA)

(73) Assignee: Advanced Upstream Ltd., Calgary (CA)

( * ) Notice: Subject to any disclaimer, the term of this patent is extended or adjusted under 35 U.S.C. 154(b) by 0 days.

This patent is subject to a terminal disclaimer.

(21) Appl. No.: 18/542,044

(22) Filed: Dec. 15, 2023

(65) Prior Publication Data

US 2024/0117695 A1 Apr. 11, 2024

Related U.S. Application Data

(63) Continuation of application No. 17/499,551, filed on Oct. 12, 2021, now Pat. No. 11,879,301.

(60) Provisional application No. 63/091,865, filed on Oct. 14, 2020.

(51) Int. Cl.

| | |
|---|---|
| ***E21B 23/08*** | (2006.01) |
| ***E21B 23/04*** | (2006.01) |
| ***E21B 34/02*** | (2006.01) |

(52) U.S. Cl.

CPC ..... *E21B 23/08* (2013.01); *E21B 23/04* (2013.01); *E21B 34/02* (2013.01)

(58) Field of Classification Search

CPC ..... E21B 33/068; E21B 23/04; E21B 23/001; E21B 34/02; B65G 51/34; B65G 53/10

See application file for complete search history.

(56) References Cited

U.S. PATENT DOCUMENTS

| | | | |
|---|---|---|---|
| 3,797,405 | A | 3/1974 | Carstens et al. |
| 4,072,109 | A | 2/1978 | Kovanov et al. |
| 4,253,530 | A | 3/1981 | Sharki et al. |
| 4,512,405 | A | 4/1985 | Sweatman et al. |
| 4,558,751 | A | 12/1985 | Huffaker |

(Continued)

FOREIGN PATENT DOCUMENTS

| | | | |
|---|---|---|---|
| CA | 2818250 | A1 | 12/2014 |
| CA | 2821324 | A1 | 1/2015 |

(Continued)

OTHER PUBLICATIONS

Purdue ECT Team, Purdue University "Pneumatic Capsule Pipeline" (2007). ECT Fact Sheets. Paper 162. http://dx.doi.org/10.5703/1288284315871.

(Continued)

*Primary Examiner* — Daniel P Stephenson

(74) *Attorney, Agent, or Firm* — Smart & Biggar LP

(57) ABSTRACT

A method for transporting an untethered wellbore completion apparatus to an outlet of a transport system that is operably coupled to and in fluid communication with a wellhead, from a location remote from the wellhead is disclosed. In some embodiments, the transporting includes propelling the object through a conductor of the transport system by moving a gaseous fluid through the conductor. In some embodiments, the object is a dart for use in a wellbore completion operation.

19 Claims, 2 Drawing Sheets

(56) References Cited

U.S. PATENT DOCUMENTS

| | | | |
|---|---|---|---|
| 4,570,705 | A | 2/1986 | Walling |
| 4,676,310 | A | 6/1987 | Scherbatskoy et al. |
| 4,700,739 | A | 10/1987 | Flohr |
| 5,215,412 | A | 6/1993 | Rogoff et al. |
| 5,526,879 | A | 6/1996 | Champ et al. |
| 6,182,765 | B1 | 2/2001 | Kilgore |
| 6,477,442 | B1 | 11/2002 | Valerino, Sr. |
| 9,027,652 | B2 | 5/2015 | Cherewyk |
| 9,611,106 | B2 | 4/2017 | Tell |
| 10,287,844 | B2 | 5/2019 | Johnson |
| 10,316,609 | B2 | 6/2019 | Conrad et al. |
| 10,527,183 | B1 | 1/2020 | Hill et al. |
| 10,947,806 | B2 | 3/2021 | Johnson |
| 11,137,109 | B2 | 10/2021 | Babineaux et al. |
| 11,879,301 | B2 * | 1/2024 | Watkins ..... E21B 23/08 |
| 2007/0215386 | A1 | 9/2007 | Burnett et al. |
| 2008/0223587 | A1 | 9/2008 | Cherewyk |
| 2013/0004248 | A1 | 1/2013 | Sundholm |
| 2016/0244655 | A1 | 8/2016 | Reddy et al. |
| 2018/0134949 | A1 | 5/2018 | Monastiriotis et al. |
| 2022/0081990 | A1 | 3/2022 | Bushman et al. |
| 2022/0112780 | A1 | 4/2022 | Watkins et al. |
| 2023/0123358 | A1 | 4/2023 | Brown et al. |
| 2024/0117695 | A1 * | 4/2024 | Watkins ..... E21B 23/08 |

FOREIGN PATENT DOCUMENTS

| | | | |
|---|---|---|---|
| CN | 201705207 | U | 1/2011 |
| CN | 204040984 | U | 12/2014 |
| EP | 0865396 | B1 | 8/1999 |
| GB | 2024137 | B | 8/1982 |
| GB | 2043576 | B | 1/1983 |
| SU | 1131793 | A1 | 12/1984 |
| SU | 1361085 | A1 | 12/1987 |
| SU | 1671899 | A1 | 8/1991 |
| WO | 2006115471 | A1 | 11/2006 |
| WO | 2023197072 | A1 | 10/2023 |

OTHER PUBLICATIONS

Bhatia, A., "Pneumatic Conveying Systems". Continuing Education and Development, Inc., Stony Point, NY. Course No. M05-010.

* cited by examiner

PNEUMATIC TRANSPORT SYSTEM AND METHOD FOR WELLBORE OPERATIONS

CROSS-REFERENCE TO RELATED APPLICATIONS

This application claims the benefit of U.S. Provisional Application No. 63/091,865, filed Oct. 14, 2020, the content of which is hereby incorporated by reference in its entirety.

FIELD

The present disclosure generally relates to transport systems and methods for wellbore operations, and more particularly to a pneumatic transport system for transporting an object toward a wellhead, and related methods.

BACKGROUND

Some wellbore operations require human technicians to physically deliver certain tools and/or materials to the wellhead. For example, in multistage wellbore completion operations, darts and/or other tools are manually transported to and deployed into the wellbore by technicians at the wellhead. Technicians typically introduce darts into the wellbore through an auxiliary line, coupled through a dart introduction valve, to the wellhead or through a dart injection apparatus supported on the wellhead, such as the plug launcher described in U.S. Pat. No. 10,947,806. The auxiliary line is fit with a valved tee or T-configuration connecting the wellhead to a fluid pumping source and to the dart introduction valve. Conventional ways of introducing darts into the wellbore, such as the dart injection apparatus supported on the wellhead, usually require the technician to approach the wellhead. Anytime the technician is in close proximity to the wellhead and surface equipment at the wellhead, through which high pressure fluids flow, there is a safety risk to the technician.

Accordingly, there is a need for technology that can transport objects, such as tools or materials, to a wellhead for deployment into a wellbore, while keeping human technicians at a safe distance from the wellhead.

SUMMARY

According to a broad aspect of the present disclosure, there is provided a method comprising: transporting an object towards an outlet of a transport system operably coupled to and in fluid communication with a wellhead from a location at a distance from the wellhead, wherein transporting comprises propelling the object through a pipeline of the transport system by moving a gas in the pipeline.

In some embodiments, moving the gas in the pipeline comprises flowing the gas in a direction from the location to the outlet.

In some embodiments, moving the gas in the pipeline comprises using one or more pumps to generate an outflow and/or intake of the gas, the one or more pumps being in communication with an inner bore of the pipeline.

In some embodiments, the method comprises, prior to transporting, deploying the object into an intake of the transport system, the intake being positioned at the location and the intake being in communication with the pipeline.

In some embodiments, the method comprises equalizing a pressure in a staging chamber of a staging assembly with a pressure in the pipeline, the staging assembly being operably coupled to and in communication with the pipeline and the outlet, and the staging chamber being configured to receive the object therein.

In some embodiments, the method comprises moving the object into the staging chamber.

In some embodiments, the method comprises, after moving the object into the staging chamber, communicating with the object by wireless communication.

In some embodiments, the method comprises, after moving the object into the staging chamber, equalizing the pressure in the staging chamber with a pressure at the outlet.

In some embodiments, the method comprises moving the object from the staging chamber to the outlet.

In some embodiments, moving the object from the staging chamber to the outlet comprises moving the object by one or both of gravity and fluid flow.

In some embodiments, the method comprises deploying the object from the outlet into a wellbore via the wellhead.

In some embodiments, the object is untethered.

In some embodiments, the gas is air.

In some embodiments, the object is a dart for use in a wellbore completion operation.

In some embodiments, the object is a capsule having a material disposed therein.

In some embodiments, the object has wheels on its outer surface.

In some embodiments, the location is at least 25 feet away from the wellhead.

According to another broad aspect of the present disclosure, there is provided a pneumatic transport system for transporting an object towards a wellhead of a wellbore, the pneumatic transport system comprising: a pipeline having an inner bore defined therein and configured to allow the object to travel in the inner bore; an intake in communication with the inner bore, the intake configured to receive the object for deployment into the inner bore; one or more pumps in communication with the inner bore for generating gas flow in the inner bore to propel the object to move in one direction in the inner bore; an outlet in communication with the wellhead; and a staging assembly having a first valve and second valve, the staging assembly being operably coupled to the pipeline via the first valve and the outlet via the second valve.

In some embodiments, a staging chamber is defined between first and second valves and the staging chamber is configured to receive the object therein, wherein: when both first and second valves are closed, communication between the staging chamber, the pipeline, and the outlet is restricted; when the first valve is open and the second valve is closed, the staging chamber is in communication with the pipeline for receiving the object from the pipeline, and communication between the staging chamber and the outlet is restricted; and when the first valve is closed and the second valve is open, the staging chamber is in communication with the outlet, allowing the object to move from the staging chamber to the outlet, and communication between the staging chamber and the pipeline is restricted.

According to yet another broad aspect of the present disclosure, there is provided the use of a pneumatic transport system for transporting an object towards a wellhead of a wellbore.

The details of one or more embodiments are set forth in the description below. Other features and advantages will be apparent from the specification and the claims.

BRIEF DESCRIPTION OF THE DRAWINGS

The invention will now be described by way of an exemplary embodiment with reference to the accompanying simplified, diagrammatic, not-to-scale drawings. Any dimensions provided in the drawings are provided only for illustrative purposes, and do not limit the invention as defined by the claims. In the drawings:

DETAILED DESCRIPTION OF THE EMBODIMENTS

When describing the present invention, all terms not defined herein have their common art-recognized meanings. To the extent that the following description is of a specific embodiment or a particular use of the invention, it is intended to be illustrative only, and not limiting of the claimed invention. The following description is intended to cover all alternatives, modifications and equivalents that are included in the scope of the invention, as defined in the appended claims.

Some pneumatic transport systems, such as pneumatic capsule pipelines (PCP), have been in use for transporting mail, printed telegraph messages, machine parts, cash receipts, books, blood samples and medication (in hospitals), and many other products. PCPs transport freight in capsules propelled by air or another gas moving through a pipeline. Capsules in PCPs are typically wheeled vehicles that can roll through pipelines. The operational speed of a PCP can range, for example, from about 20 feet per second to about 50 feet per second.

The system and method described below use pneumatic transport technology to transport objects, such as tools or materials, toward a wellhead of a wellbore without the need for a human technician to approach the wellhead. The wellhead may be a conventional wellhead that includes valves and a pipeline connection block, such as a frachead, which provides fluid connections for introducing stimulation fluids, including sand, gels, and acid treatments, into the wellbore. Tools that can be delivered to the wellhead by the system and method described herein may be, for example, untethered darts for multi-stage well completion operations. In some embodiments, the materials to be delivered to the wellhead by the system may be placed in a capsule and the capsule can be transported to the wellhead by the system. In general, a pneumatic transport system is connected to the wellhead for delivering one or more objects to the wellhead for deployment into the corresponding wellbore. In some embodiments, the pneumatic transport system uses only gas flow, or at least substantially by gas flow, to propel the object in at least a part of the system.

Figure 1:
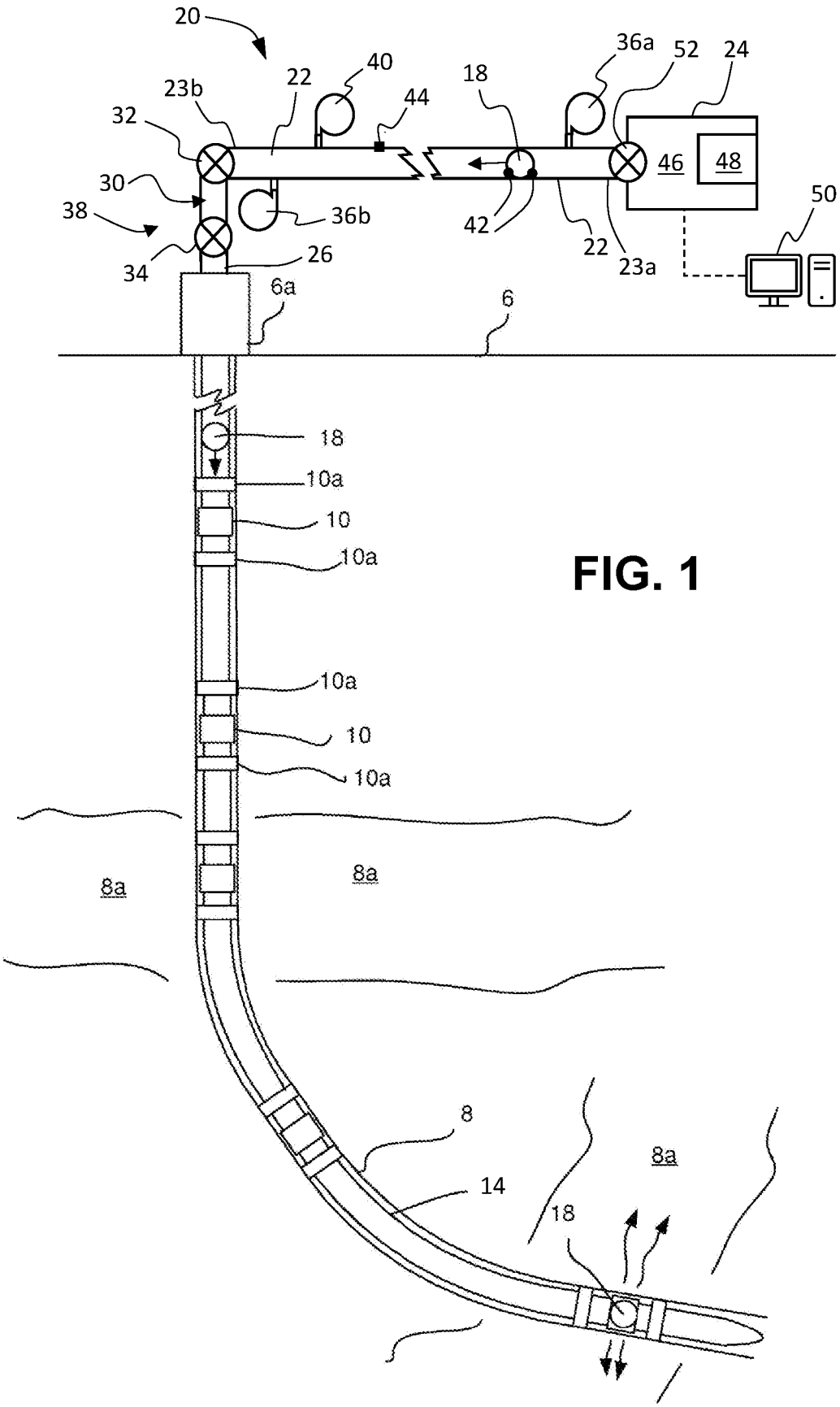
FIG. 1 is a schematic view of a pneumatic transport system connected to a wellhead of a wellbore, according to one embodiment of the present disclosure.

FIG. 1 shows a pneumatic transport system 20 operably connected to a wellhead 6*a* of a wellbore 8. The wellhead 6*a* is in communication with the inner bore of a tubing string 14 that extends inside the wellbore 8. The pneumatic transport system 20 comprises a pipeline 22, one or more pumps 36*a*,36*b*,40, an intake 24, and an outlet 26. In some embodiments, the system 20 comprises a staging assembly 38. In some embodiments, the system 20 may comprise a storage facility (not shown) connected to one of the pipelines 22, one or more valves (e.g., valves 32,34), a flowmeter (not shown), a sensor (e.g., sensor 44), control equipment (e.g., computer 50), and/or communication equipment (e.g., computer 50). In the illustrated embodiment, the system 20 is configured to transport an object 18 (for example, an untethered dart) to the wellhead 6*a* such that the object 18 can be deployed into the wellbore 8 via the wellhead 6*a*, all of which will be described in more detail below.

The pipeline 22 has defined therein an inner axial bore, configured and sized to accommodate one or more objects 18 to be transported therethrough. For simplicity, the pipeline 22 in FIG. 1 is shown as one continuous segment; however, in other embodiments, the pipeline 22 may comprise a plurality of pipeline segments that are joined together by joints (not shown) or other components of the system 20. In some embodiments, which are not shown here, the pneumatic transport system may comprise a plurality of pipelines 22 which may be interconnected with one another to provide a network of pipelines through which objects 18 may be transported to the wellhead 6*a* from more than one location remote from the wellhead. In the illustrated embodiment, the pipeline 22 has a distal end 23*a*, which may be located at a remote location some distance from a wellhead 6*a*, and a proximal end 23*b* that is closer to the wellhead 6*a* than the distal end 23*a*. In some embodiments, one or more portions of the pipeline 22 may be made of transparent or translucent material to allow a technician to visually confirm the presence of object 18 at one or more locations in the pipeline 22. In alternative or additional embodiments, the system 20 may comprise one or more sensors 44 along the pipeline 22 for detecting the presence of object 18 in the pipeline 22.

Intake 24 is operably coupled to and in communication with the inner bore of the pipeline 22, either at the distal end 23*a* of the pipeline 22 as illustrated in FIG. 1 or at any axial location of the pipeline 22. Intake 24 is configured to receive one or more objects 18 and provide the objects 18 access to the inner bore of the pipeline 22 so that the objects 18 can be deployed into the pipeline 22 from the intake 24. In some embodiments, the intake 24 is in the form of an opening in the wall of the pipeline 22. In other embodiments, the intake 24 is a receptacle configured to receive one or more objects 18 for deployment into the pipeline 22. In some embodiments, intake 24 is open to its surroundings and the atmosphere. In other embodiments, the intake 24 is closed off from its surroundings and the atmosphere but can be selectively opened to permit loading of one or more objects 18 into the intake 24. In the illustrated embodiment, the intake 24 comprises a housing 46 that is generally closed to its surroundings and the housing has a door 48 that can be selectively opened to provide access to the interior of the housing.

In some embodiments, intake 24 is positioned at a remote location at some distance away from the wellhead 6*a*. In some embodiments, the distance between the wellhead 6*a* and the intake 24 is at least, for example, about 25 feet in order to maintain a safe distance between the wellhead 6*a* and a technician loading objects 18 into the intake 24. In other embodiments not shown here, system 20 may comprise a plurality of intakes 24, each of which may be at a different location relative to the wellhead 6*a* than the other intakes, such that objects 18 may be transported to the wellhead 6*a* from more than one remote location.

In some embodiments, the staging assembly 38 is operably coupled to and in communication with the pipeline 22. The staging assembly 38 is in communication with the intake 24 via the pipeline 22. In the illustrated embodiment, the staging assembly 38 is positioned at the proximal end 23*b* of pipeline 22. In other embodiments, which are not shown here, the staging assembly 38 may be positioned at any axial location along the pipeline 22. The staging assembly 38 is also operably coupled to and in communication with the outlet 26, which is operably coupled to the wellhead 6*a*. In some embodiments, the staging assembly 38 is positioned at or near the wellhead 6*a* and may be positioned directly above the wellhead 6*a*, such that the object 18 travels mostly by gas propulsion in the pipeline 22 before arriving at the wellhead 6*a*.

In the illustrated embodiment shown in FIG. 1, the staging assembly 38 comprises a first valve 32, a second valve 34, and a staging chamber 30 defined between the first and second valves 32,34. The staging chamber 30 is configured to receive one or more objects 18 therein and to allow the objects 18 to pass therethrough. The first valve 32 is in communication with the pipeline 22 and the chamber 30, and is configured to control communication between the staging chamber 30 and the pipeline 22. The second valve 34 is in communication with the outlet 26 and the chamber 30, and is configured to control communication between the staging chamber 30 and the outlet 26. When the first and second valves 32,34 are both closed, the chamber 30 is fluidly sealed and isolated from the pipeline 22 and the outlet 26. When the first valve 32 is open and the second valve 34 is closed, chamber 30 is in communication with and has open access to the pipeline 22 but is not in communication with the outlet 26. Therefore, when the first valve 32 is open and the second valve 34 is closed, communication between the staging chamber 30 and the outlet 26 is restricted. When the first valve 32 is closed and the second valve 34 is open, chamber 30 is in communication with and has open access to the outlet 26 but is not in communication with the pipeline 22. Therefore, when the first valve 32 is closed and the second valve 34 is open, communication between the staging chamber 30 and the pipeline 22 is restricted.

In some embodiments, the staging assembly 38 may be configured and positioned such that the second valve 34 is below the first valve 32 relative to the ground surface 6, i.e., the force of gravity pulls objects in the staging chamber 30 in the direction towards the second valve 34. In the illustrated, the staging assembly 38 is substantially vertically positioned such that the second valve 34 is directly below the first valve 32; however, other configurations of the staging assembly 38 are possible.

The staging assembly 38 has ports (not shown) for sealingly connecting to fluid lines (not shown). The ports of the staging assembly 38 are in communication with the chamber 30 for removal of fluid to depressurize or bleed-off internal pressure of the chamber 30 and/or for injection fluid to pressurize the chamber 30. The staging assembly 38 is configured to allow the pressure in chamber 30 to be equalized with the pressure in the pipeline 22 or the pressure in the outlet 26 at any given time. Equalizing the pressure in chamber 30 may comprise pressurizing or depressurizing the chamber 30 by, for example, injection or removal of fluids (gas and/or liquid) into or out of the chamber 30 via the one or more ports of the staging assembly 38. Other ways of equalizing the pressure in chamber 30 may be possible. Equalizing the pressure does not necessarily mean that the pressure in the chamber 30 is the same as the pressure in the pipeline 22 (or outlet 26). Rather, the equalization of pressures is achieved when the difference in pressures in the chamber 30 and the pipeline (or outlet) is less than a predetermined pressure differential threshold such that opening the first valve 32 (or the second valve 34) would not cause a sudden spike in pressure that would shock the system 20 and cause undue stress or damage to the system 20. In some embodiments, the staging assembly 38, including its valves 32,34, is made of standard API pressure control equipment suitable to handle typical wellbore pressures.

The outlet 26 is operably connected to and in fluid communication with the wellhead 6*a*. In some embodiments, the outlet 26 is connected to a component of the wellhead 6*a* such that the outlet 26 is in direct or indirect fluid communication with the inner bore of the tubing string 14 via the wellhead 6*a*. In the illustrated embodiment, the outlet 26 is directly connected to the wellhead 6*a* and is positioned directly above the wellhead 6*a* relative to the ground surface 6.

The pneumatic transport system 20 operates under fluid mechanic principles. In some embodiments, air is blown down and/or extracted from the pipeline 22 to propel object 18 along at least a portion of the inner bore of the pipeline 22. The object 18 is propelled entirely or almost entirely by movement of air inside pipeline 22, for example, by displacement and/or by compression of air. Object 18 may be equipped with wheels 42 or other mechanisms (e.g., wiper seals (not shown)) on its outer surface to allow the object 18 to be easily propelled and/or glide through the inner bore of the pipeline 22. In one embodiment, air is blown through the inner bore of pipeline 22 by a pump 36*a* positioned at or near the intake 24 of the pipeline or at or near the distal end 23*a*. The outflow of air generated by pump 36*a* creates a positive pressure in the pipeline 22.

In an alternative or additional embodiment, air is drawn out of the inner bore of pipeline 22 by a pump 36*b* positioned at or near the staging assembly 38 or at a location of the pipeline further away from the intake 24 (or distal end 23*a*) than pump 36*a*. The intake of air by pump 36*b* creates a negative pressure in the pipeline 22. Whichever the configuration, the one or more pumps in system 20 generate airflow inside pipeline 22 to propel the object 18 to travel in one direction. For example, one or both of pumps 36*a*,36*b* cause the air inside the pipeline 22 to flow in the direction from the intake 24 (or the distal end 23*a*) to the staging assembly 38.

In some embodiments, where it is desired to transport more than one object 18 through the pipeline 22 simultaneously, the system 20 may comprise one or more booster pumps 40 at an intermediate location (i.e., somewhere between the intake 24 and staging assembly 38 and/or between pumps 36*a*,36*b*) in the pipeline 22. The booster pumps 40 create the pressure differential required to propel multiple objects 18 through the pipeline 22 at the same time.

The one or more pumps 36*a*,36*b*,40 are each configured to provide an outflow or intake of air depending upon the location of the pump and may comprise, for example, a vacuum pump, a compressor, a blower, or a combination thereof. In some embodiments, the pump is a high-pressure blower, the output capacity of which depends on the length, elevation differential, and the configuration of the pipeline 22.

In some embodiments, air is used in the pipeline 22 of the pneumatic transport system 20 to propel object 18 because air is abundant, free, does not react chemically to many things, and is not hazardous to the environment. In some embodiments, a gas other than air is used if the object 18 to be transported can explode, corrode, ignite, or combust in the presence of air. The term "gas" includes air and other gases. Gases that do not freeze in cold climates can be used to transport the object 18 in the pipeline 22, which allows the pneumatic transport system 20 to operate year-round.

In some embodiments, system 20 is operated by control equipment and/or communication equipment, such as a computer 50, that can be remotely accessed and controlled by a technician who is located offsite (or at least at a safe distance from the wellhead 6*a*). The computer 50 is configured to monitor the pressure, flow rates, and other parameters along the pipeline and may perform analysis and send commands to control various components of the system 20 (e.g., valves, pumps, etc.) to optimize the efficiency of the system 20. In some embodiments, a supply of objects 18 is located at or near the intake 24 and the deployment of each object 18 into the pipeline 22 via intake 24 can be automated through the computer 50 and/or robotics. In other embodiments, where the intake 24 is located sufficiently far away from the wellhead 6*a*, object 18 may be deployed into the pipeline 22 manually by a technician.

In an optional embodiment, the system 20 comprises a valve 52 configured to control the communication between the intake 24 and the inner bore of pipeline 22. When valve 52 is closed, the intake 24 can be safely opened to the atmosphere, for example, by opening door 48, at least during loading of object 18 into intake 24. The door 48 may be closed prior to reopening valve 52, for example, after loading of object 18 is completed. In other embodiments, the pressure differential between the inner bore of pipeline 22 and the atmosphere is small enough that valve 52 may be omitted or the valve 52, if included, may be open while the intake 24 is open to the atmosphere. In still other embodiments, the valve 52 may be open or omitted if the operation of the one or more pumps 36*a*,36*b*,40 is suspended while object 18 is being loaded into intake 24. In these embodiments, once the door 48 of the intake 24 is closed, the operation of the one or more pumps 36*a*,36*b*,40 can resume. Because a gas is used, rather than a liquid, to propel object 18 in pipeline 22, the intake 24 may remain open to the atmosphere at all times without being a safety hazard to nearby technicians, even in embodiments where valve 52 is omitted.

Figure 2:
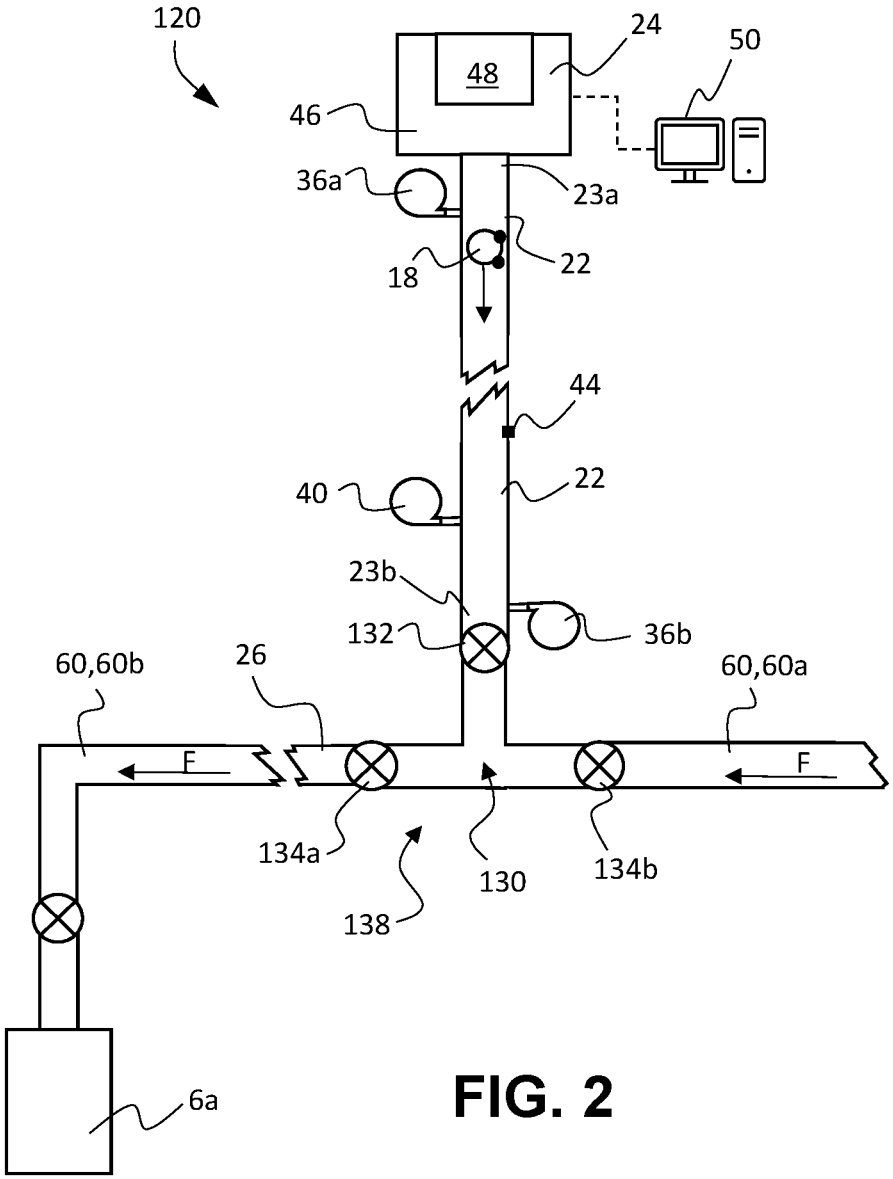
FIG. 2 is a schematic view of a pneumatic transport system connected to a wellhead of a wellbore via a fluid line, according to another embodiment of the present disclosure. For simplicity, the pneumatic transport system in FIG. 2 is only shown with the wellhead and fluid line.

FIG. 2 shows a pneumatic transport system 120 according to an alternative embodiment. For simplicity, the pneumatic transport system 120 is only shown in relation to the wellhead 6*a*; and the wellbore 8 and other components below ground surface 6 are omitted. Like parts in system 20 and system 120 shown in FIGS. 1 and 2, respectively, are denoted by the same reference numbers and are not described again with respect to system 120. In FIG. 2, the pneumatic transport system 120 is positioned some distance away from the wellhead 6*a* and is connected to wellhead 6*a* via a fluid line 60 that feeds into the wellhead 6*a*. The direction of fluid flow in fluid line 60 is denoted by arrows F. In the illustrated embodiment, the system 120 is connected to the fluid line 60 at an axial location of the fluid line 60 some distance away from the wellhead 6*a*. One or more sections of the pipeline 22 may extend substantially horizontally, i.e., substantially parallel to the ground surface. In some embodiments, one or more sections of the pipeline 22 may be in the same horizontal plane as the fluid line 60.

The system 120 comprises a staging assembly 138 and an outlet 26 that are configured to operably connect to the fluid line 60 or can be integrated with the fluid line 60, at a location along the length of the fluid line 60, to permit fluid communication between the fluid line 60, the staging assembly 138, and the outlet 26. In some embodiment, the location along fluid line 60 at which the staging assembly 138 is positioned is at some distance away from the wellhead 6*a* (e.g. at least feet away from the wellhead 6*a*). In the illustrated embodiment, the outlet 26 is an axial section of the fluid line 60. When the staging assembly 138 and the outlet 26 are operably coupled to the fluid line 60, the portion of the fluid line 60 downstream of the outlet 26 acts as an extension of the outlet and thus operably couples the outlet 26 to the wellhead 6*a* so that the outlet 26 and the wellhead 6*a* are in fluid communication with one another. When the outlet 26 is operably coupled to and in fluid communication with the wellhead 6*a* as describe herein, the system 120 is also operably coupled to and in communication with the wellhead 6*a*.

In the illustrated embodiment, the staging assembly 138 has a first valve 132, a second valve 134*a*, and third valve 134*b*. A staging chamber 130 is defined between the valves 132,134*a*,134*b*. The staging chamber 130 is configured to receive one or more objects 18 therein and to allow the objects 18 to pass therethrough. The first valve 132 is in communication with the chamber 130 and the pipeline 22. The first valve 132 is configured to control communication between the staging chamber 130 and the pipeline 22. The second and third valves 134*a*,134*b* are in communication with the chamber 130 and the fluid line 60, at different axial location of the fluid line 60. The second valve 134*a* is configured to control communication between the outlet 26 (and a portion 60*b* of the fluid line 60 downstream from staging assembly 138) and the chamber 130. The third valve 134*b* is configured to control communication between the staging chamber 130 and a portion 60*a* of the fluid line 60 upstream of the staging assembly 138.

When all the valves 132,134*a*,134*b* are closed, the chamber 130 is fluidly sealed and isolated from the pipeline 22, the outlet 26, and the fluid line 60. When the first valve 132 is open and the second and third valves 134*a*,134*b* are closed, chamber 130 is in communication with and has open access to the pipeline 22 but is not in communication with the outlet 26 or the fluid line 60. Therefore, when the first valve 132 is open and the second and third valves 134*a*,134*b* are closed, communication between the staging chamber 130 and the outlet 26 (and the fluid line 60) is restricted, and fluid flow in fluid line 60 is blocked at chamber 130, thus interrupting fluid communication between the upstream portion 60*a* and downstream portion 60*b* of the fluid line 60. When the first valve 132 is closed and the second and third valves 134*a*,134*b* are open, chamber 130 is in communication with and has open access to the outlet 26 and the fluid line 60 but is not in communication with the pipeline 22. Therefore, when the first valve 132 is closed and the second and third valves 134*a*,134*b* are open, communication between the staging chamber 130 and the pipeline 22 is restricted, and fluid flow in fluid line 60 is unrestricted through chamber 130 such that the flow of fluid along fluid line 60 is uninterrupted.

The staging assembly 138 has ports (not shown) for sealingly connecting to fluid lines (not shown). The ports of the staging assembly 138 are in communication with the chamber 130 for removal of fluid to depressurize or bleed-off internal pressure of the chamber 130 and/or for injection fluid to pressurize the chamber 130. The staging assembly 138 is configured to allow the pressure in chamber 130 to be equalized with the pressure in the pipeline 22 or the pressure in the fluid line 60 at any given time. In some embodiments, the staging assembly 138, including its valves 132,134*a*, 134*b*, is made of standard API pressure control equipment suitable to handle typical wellbore pressures.

As a skilled person in the art can appreciate, FIGS. 1 and 2 only show sample configurations of the pneumatic transport system. In other embodiments, the specific configuration of the pneumatic transport system, such as the route of the pipeline, the operational velocity, pressure gradient, the type of pumps and other equipment, pipeline thickness and material, etc., depends on the particular application and environment of the system and the properties of the objects to be transported. While the pneumatic transport system 20 is shown to be entirely above ground surface 6, at least a portion of the system 20 may be situated underground in other embodiments.

In the sample embodiment shown in FIG. 1, the object 18 is an untethered dart that is deployable into wellbore 8 for performing multistage completion operations. However, as can be appreciated by those skilled in the art, the system and method described herein can be used in other applications. In FIG. 1, completion tubing string 14 extends into wellbore 8 which intersects multiple zones of a subterranean formation 8*a*. The string 14 has installed thereon, intermittently along its length, a plurality of multistage fracturing devices 10 (MFDs) and packer elements 10*a* for isolating particular zones within the formation 8*a*. The combination of MFDs 10 and packer elements 10*a* enable fracturing operations to be conducted within the formation 8*a*, the specific techniques for which are known to those in the art.

In the illustrated embodiment, the MFDs 10 are connected to the completion tubing string 14 between packer elements 10*a* at positions that correspond to various zones of formation 8*a* within the wellbore 8. Generally, after placement of the completion tubing string 14 within the wellbore 8, the packer elements 10*a* are activated to seal against the inner wall of the wellbore 8. In some embodiments, each MFD 10 has a valve that is initially closed but can be selectively opened by a dart 18. For example, the valve may have a sleeve configured to catch the dart 18 and, to open the valve, fluid pressure is increased above the dart 18 caught in the sleeve to exert a downward force on the sleeve to shift the sleeve to an open position.

In operation, when it is desired to open the valve of a particular MFD 10 (the "target MFD"), circulation is first established in the wellbore 8. With at least the first valve 32 of the staging assembly 38 initially closed, a dart 18 is supplied to the pneumatic transport system 20 at the intake 24, either automatically by the computer or manually by a technician, and the dart 18 is introduced into the pipeline 22 via the intake. If the intake 24 is initially closed off, the intake 24 is opened and then the dart 18 is loaded into the intake 24. If valve 52 is included in system 20, the valve 52 may be closed prior to opening intake 24 and reopened after the dart 18 is received in the intake and the intake is closed again. Once valve 52 reopens, the dart 18 is drawn into the pipeline 22 by the flow of air in the pipeline. Where valve 52 is omitted or is not closed, the dart 18 is drawn into the pipeline 22 directly after the dart 18 is loaded into the intake 24. As described above, the intake 24 may be at a remote location some distance away from the wellhead 6*a*.

The dart 18 is propelled by the air flow in the pipeline 22 and travels down the inner bore of the pipeline 22 towards the staging assembly 38. In some embodiments, the dart 18 may be equipped with wheels on its outer surface to facilitate its movement inside pipeline 22.

Since the first valve 32 is closed, the dart 18 cannot yet enter the staging chamber 30 of the staging assembly 38. Either before or after the dart arrives at the first valve 32, the second valve 34 is closed to seal chamber 30 and then the pressure in chamber 30 is equalized with the pressure in the pipeline 22, as described above.

After the pressure in chamber 30 is equalized with that of the pipeline 22, the first valve 32 is opened, thereby allowing the dart 18 to enter chamber 30. The dart 18 may be moved into chamber 30 by air flow (e.g., movement of air in the pipeline 22 or in the chamber 30) and/or by the force of gravity (e.g., where the staging assembly 38 is substantially vertically positioned as shown in the illustrated example in FIG. 1). After the dart 18 is received in chamber 30, the first valve 32 is closed. In some embodiments, where the dart 18 is a programmable dart, the dart 18 may be programmed by wireless communication while the dart is received in chamber 30. The materials of the staging assembly 38 and/or chamber 30 may be configured to permit wireless communication between control equipment (e.g., computer 50) and the dart 18.

With the dart inside chamber 30 and both valves 32,34 closed, the staging chamber 30 is once again sealed and then the pressure in chamber 30 is equalized with the pressure at the outlet 26, the outlet 26 being operably coupled to and in communication with the wellhead 6*a* as described above. In some embodiments, the outlet 26 is at the same pressure as that at the wellhead 6*a*, which is the wellbore pressure. Once the pressure in chamber 30 is equalized with the pressure at the outlet 26, the second valve 34 is opened, thereby allowing the dart to exit the chamber 30 and enter the wellhead 6*a* via outlet 26. The dart 18 may be removed from the chamber 30 and introduced into the wellhead 6*a* by fluid flow (e.g., movement of fluid in the chamber 30 or at the outlet 26) and/or by the force of gravity. After exiting chamber 30, the dart 18 is then deployed into the completion tubing string 14, for example, by gravity and/or by the flow of fluids pumped into the tubing string via the wellhead 6*a*.

The dart 18 may be conveyed through the completion tubing string 14 by gravity and/or the pumped fluid to engage with the target MFD. When the dart 18 reaches the target MFD, the target MFD catches the dart 18 (see, for example, the lowermost MFD 10 in FIG. 1), by any of the various techniques known in the art. When the dart 18 is caught, the dart 18 seals the interior of the completion tubing string 14 from the portion of the completion tubing string downhole from the dart. Fluid pressure can then be increased above the dart 18 to open the valve of the target MFD. When the valve in the target MFD is opened, a fracturing operation can be completed within the zone of interest in formation 8*a* adjacent to the target MFD.

After the zone of interest has been fractured, further darts 18 can be introduced, one at a time in some embodiments, into the completion tubing string 14 via the pneumatic transport system 20, as described above, to enable successive MFDs 10 to be opened and fracturing operations to be completed in other zones of the formation 8*a*. Accordingly, multiple zones within the well 8 can be fractured.

In some embodiments, the darts 18 are configured to at least partially dissolve after a period of time, typically a few days, such that the darts diminish in size and are released from the MFDs to fall to the bottom of the well. In some embodiments, the wheels on the outer surface of the dart 18 are configured to dissolve when exposed to wellbore fluids. Thus, after the fracturing operations have been completed, all the fractured zones of the well 8 are opened to the interior of the completion tubing string 14 to allow production of the well 8.

Referring to FIG. 2, system 120 is connected to the wellhead 6*a* which is in communication with the tubing string 14 having installed thereon a plurality of MFDs 10, all as described above with respect FIG. 1 but not shown in FIG. 2. In operation, when it is desired to open the valve of the target MFD, circulation is established in the wellbore 8 by, for example, pumping fluids into the tubing string 14 via fluid line 60, while the first valve 132 of the staging assembly 138 is closed and the second and third valves 134*a*,134*b* are open. With the second and third valves

134*a*,134*b* open, fluid can flow along fluid line 60 uninterrupted through the staging chamber 130. A dart 18 is then supplied to the pneumatic transport system 120 at the intake 24 and introduced into the pipeline 22 at the distal end 23*a*. The dart 18 is propelled by the air flow in the pipeline 22 and travels down the inner bore of the pipeline 22 towards the staging assembly 138.

Since the first valve 132 is closed, the dart 18 cannot yet enter the staging chamber 130 of the staging assembly 138. Either before or after the dart arrives at the first valve 132, the second and third valves 134*a*,134*b* are closed to seal chamber 130 and then the pressure in chamber 130 is equalized with the pressure in the pipeline 22, as described above. When the second and third valves 134*a*,134*b* are closed, fluid communication between the upstream portion 6*a* and the downstream portion 6*b* of fluid line 60 is blocked at chamber 130. In some embodiments, the supply of fluid into fluid line 60 may be paused while the second and third valves 134*a*,134*b* are closed.

After the pressure in chamber 130 is equalized with that of the pipeline 22, the first valve 132 is opened, thereby allowing the dart 18 to enter chamber 130. The dart 18 may be moved into chamber 130 by air flow and/or by the force of gravity. After the dart 18 is received in chamber 130, the first valve 32 is closed. In some embodiments, the dart 18 may be programmed by wireless communication while the dart is received in chamber 130, as described above.

With the dart inside chamber 130 and all the valves 132,134*a*,134*b* closed, the staging chamber 30 is once again sealed and then the pressure in chamber 130 is equalized with the pressure at the outlet 26, the outlet 26 being operably coupled to and in communication with the wellhead 6*a* via fluid line 60 as described above. The outlet 26 may be at the same pressure as the fluid line 60 downstream of the staging assembly 138. In some embodiments, the outlet 26 is at the same pressure as that at the wellhead 6*a*, which is the wellbore pressure. Once the pressure in chamber 130 is equalized with the pressure at the outlet 26, the second and third valves 134*a*,134*b* are opened, thereby reestablishing fluid communication between the upstream section 60*a* and the downstream section 60*b* of the fluid line 60. Further, with the second and third valves 134*a*,134*b* open and fluid flowing through the chamber 130, the dart 18 is propelled by the fluid in fluid line 60 to exit the chamber 130 and enter the downstream portion 60*b* of the fluid line 60 via the outlet 26. After exiting chamber 130, the dart 18 travels through the downstream portion 60*b* and is then deployed into the completion tubing string 14 via the wellhead 6*a*. The dart 18 may then engage the target MFD as described above.

It should be noted that the description uses various terms interchangeably with other terms for the purposes of functional description and/or to represent examples of specific embodiments. Importantly, the use of one term as compared to another is not intended to be limiting with regards to the scope of interpretation by those skilled in the art. For example, a multistage fracturing device may be referred to as a tubular hydraulic valve, and a dart may be referred to as a ball, a plug, or the like.

Interpretation of Terms

Unless the context clearly requires otherwise, throughout the description and the "comprise", "comprising", and the like are to be construed in an inclusive sense, as opposed to an exclusive or exhaustive sense; that is to say, in the sense of "including, but not limited to"; "connected", "coupled", or any variant thereof, means any connection or coupling, either direct or indirect, between two or more elements; the coupling or connection between the elements can be physical, logical, or a combination thereof; "herein", "above", "below", and words of similar import, when used to describe this specification, shall refer to this specification as a whole, and not to any particular portions of this specification; "or", in reference to a list of two or more items, covers all of the following interpretations of the word: any of the items in the list, all of the items in the list, and any combination of the items in the list; the singular forms "a", "an", and "the" also include the meaning of any appropriate plural forms.

Where a component is referred to above, unless otherwise indicated, reference to that component should be interpreted as including as equivalents of that component any component which performs the function of the described component (i.e., that is functionally equivalent), including components which are not structurally equivalent to the disclosed structure which performs the function in the illustrated exemplary embodiments.

The previous description of the disclosed embodiments is provided to enable any person skilled in the art to make or use the present invention. Various modifications to those embodiments will be readily apparent to those skilled in the art, and the generic principles defined herein may be applied to other embodiments without departing from the spirit or scope of the invention. Thus, the present invention is not intended to be limited to the embodiments shown herein but is to be accorded the full scope consistent with the claims. All structural and functional equivalents to the elements of the various embodiments described throughout the disclosure that are known or later come to be known to those of ordinary skill in the art are intended to be encompassed by the elements of the claims. Moreover, nothing disclosed herein is intended to be dedicated to the public regardless of whether such disclosure is explicitly recited in the claims. It is therefore intended that the following appended claims and claims hereafter introduced are interpreted to include all such modifications, permutations, additions, omissions, and sub-combinations as may reasonably be inferred. The scope of the claims should not be limited by the preferred embodiments set forth in the examples but should be given the broadest interpretation consistent with the description as a whole.

What is claimed is:

1. A method of transporting a wellbore completion apparatus, via a transport system, from a remote location to a wellhead for deployment into a wellbore, wherein the transport system includes an intake, a staging chamber-communicating conductor, a staging chamber, and a wellhead-communicating conductor, wherein the method comprises:

under atmospheric conditions, loading the wellbore completion apparatus into the intake;

modulating pressure within the staging chamber;

after the modulating of the pressure within the staging chamber, propelling the wellbore communication apparatus, with flowing fluid, via the staging chamber-communicating conductor, to the staging chamber, such that the wellbore communication apparatus becomes emplaced within the staging chamber;

while the wellbore completion apparatus is emplaced within the staging chamber, reconfiguring the transport system such that the wellbore completion apparatus becomes contained within the staging chamber;

defeating the containing of the wellbore completion apparatus within the staging chamber;

after the defeating of the containing, motivating displacement of the wellbore completion apparatus, via the wellhead-communicating conductor, from the pressure-modified staging chamber to the wellhead.

2. The method as claimed in claim 1;
wherein:
the staging chamber-communicating conductor defines a staging chamber-communicating passageway; and
the modulating of pressure, within the staging chamber, is based on a comparison between a pressure within the staging chamber-communicating passageway and a pressure within the staging chamber.

3. The method as claimed in claim 1;
wherein:
the modulating of pressure, within the staging chamber, is with effect that any pressure gradient, from the staging chamber-communicating passageway to the staging chamber, is below a predetermined threshold pressure differential.

4. The method of as claimed in claim 1;
further comprising:
while the wellbore completion apparatus is contained within the staging chamber, reconfiguring the wellbore completion apparatus.

5. The method as claimed in claim 1;
wherein:
the wellbore completion apparatus is a dart.

6. The method as claimed in claim 1;
wherein:
the wellbore completion apparatus is an untethered apparatus.

7. The method as claimed in claim 1;
wherein:
the fluid, of the flowing fluid, is a gaseous fluid.

8. A method of transporting a wellbore completion apparatus, via a transport system, from a remote location to a wellhead for deployment into a wellbore, wherein the transport system includes an intake, a staging chamber-communicating conductor, a staging chamber, and a wellhead-communicating conductor, wherein the method comprises:
under atmospheric conditions, loading the wellbore completion apparatus into the intake;
propelling the wellbore communication apparatus, via the staging chamber-communicating conductor, from the intake to the staging chamber, with flowing fluid, such that the wellbore communication apparatus becomes emplaced within the staging chamber;
while the wellbore completion apparatus is emplaced within the staging chamber, reconfiguring the transport system such that the wellbore completion apparatus becomes contained within the staging chamber;
while the wellbore completion apparatus is contained within the staging chamber, modulating pressure within the staging chamber;
after the modulating of the pressure within the staging chamber, defeating the containing of the wellbore completion apparatus within the staging chamber; and
after the defeating of the containing, motivating displacement of the wellbore completion apparatus, via the wellhead-communicating conductor, from the pressure-modified staging chamber to the wellhead.

9. The method as claimed in claim 8;
wherein:
the staging chamber-communicating conductor defines a staging chamber-communicating passageway; and
the modulating of pressure, within the staging chamber, is based on a comparison between a pressure within the staging chamber-communicating passageway and a pressure within the staging chamber.

10. The method as claimed in claim 8;
wherein:
the modulating of pressure, within the staging chamber, is with effect that any pressure gradient, from the staging chamber-communicating passageway to the staging chamber, is below a predetermined threshold pressure differential.

11. The method as claimed in claim 8;
further comprising:
while the wellbore completion apparatus is contained within the staging chamber, reconfiguring the wellbore completion apparatus;
wherein:
the defeating of the containing is effected after the reconfiguring of the wellbore completion apparatus.

12. The method as claimed in claim 8;
wherein:
the wellbore completion apparatus is a dart.

13. The method as claimed in claim 8;
wherein:
the wellbore completion apparatus is an untethered apparatus.

14. The method as claimed in claim 8;
wherein:
the fluid, of the flowing fluid, is a gaseous fluid.

15. A method of transporting a wellbore completion apparatus, via a transport system, from a remote location to a wellhead for deployment into a wellbore, wherein the transport system includes an intake, a staging chamber-communicating conductor, a staging chamber, and a wellhead-communicating conductor, wherein the method comprises:
under atmospheric conditions, loading the wellbore completion apparatus into the intake;
propelling the wellbore communication apparatus, via the staging chamber-communicating conductor, to a pressure-modified staging chamber, such that the wellbore communication apparatus becomes emplaced within the staging chamber;
while the wellbore completion apparatus is emplaced within the staging chamber, reconfiguring the transport system such that the wellbore completion apparatus becomes contained within the staging chamber;
while the wellbore completion apparatus is contained within the staging chamber, re-configuring the wellbore completion apparatus, with effect that a wellbore completion-ready apparatus is obtained;
after the re-configuring of the wellbore completion apparatus, defeating the containing of the wellbore completion apparatus within the staging chamber; and
after the defeating of the containing, motivating displacement of the wellbore completion-ready apparatus, via the wellhead-communicating conductor, from the staging chamber to the wellhead.

16. The method as claimed in claim 15;
wherein:
the wellbore completion apparatus is a dart.

17. The method as claimed in claim 15;
wherein:
the wellbore completion apparatus is an untethered apparatus.

18. The method as claimed in claim 15;
wherein:
the propelling is effected by flowing fluid.

19. The method as claimed in claim 18;
wherein:
the fluid, of the flowing fluid, is a gaseous fluid.

* * * * *